US005388919A

United States Patent [19]

Kimura et al.

[11] Patent Number: 5,388,919

[45] Date of Patent: Feb. 14, 1995

[54] PRINTING DEVICE WITH A TILTABLE PRINTING HEAD

[75] Inventors: Hiroaki Kimura, Kani; Shigeo Ishikawa, Hazu; Toshiaki Sugiura, Hekinan, all of Japan

[73] Assignee: Brother Kogyo Kabushiki Kaisha, Nagoya, Japan

[21] Appl. No.: 44,170

[22] Filed: Apr. 8, 1993

[30] Foreign Application Priority Data

Apr. 10, 1992 [JP] Japan ..... 4-118070

[51] Int. Cl.[6] ..... B41J 25/316

[52] U.S. Cl. ..... 400/55; 400/354; 400/355

[58] Field of Search ..... 400/55, 59, 121, 124, 400/124 VI, 126, 352, 354, 355; 346/139 R; 347/40, 41

[56] References Cited

U.S. PATENT DOCUMENTS

| | | | |
|---|---|---|---|
| 4,784,503 | 11/1988 | Bettini | 400/352 |
| 4,787,759 | 11/1988 | Geis et al. | 400/55 |
| 4,906,115 | 3/1990 | Bischof | 400/55 |
| 4,979,835 | 12/1990 | Beck et al. | 400/59 |
| 5,000,590 | 3/1991 | Einem | 400/355 |
| 5,083,143 | 1/1992 | Hoffman | 400/352 |

FOREIGN PATENT DOCUMENTS

| | | | |
|---|---|---|---|
| 192671 | 10/1985 | Japan | 400/59 |
| 154869 | 7/1986 | Japan | 400/355 |
| 62-176852 | 8/1987 | Japan | 400/124 VI |
| 270363 | 11/1987 | Japan | 400/59 |
| 203650 | 9/1991 | Japan | 400/354 |

*Primary Examiner*—David A. Wiecking
*Attorney, Agent, or Firm*—Oliff & Berridge

[57] ABSTRACT

The carriage mounting the print head, for a printer, is supported at an upper guide bar with an upper bearing and at a lower guide bar with a lower-right bearing and a lower-left bearing. The printing device prints characters while driving the print head in reciprocal movement along the guide bars. The lower-left bearing has an eccentric center relative to the axis of the lower-guide bar. A lever fitted on the lower-left bearing allows the operator to rotate the lower-left bearing relative to the axis of the lower guide bar to adjust the height of print.

18 Claims, 7 Drawing Sheets

PRINTING DEVICE WITH A TILTABLE PRINTING HEAD

BACKGROUND OF THE INVENTION

1. Field of the Invention

The invention relates to a printing device, and more particularly to a printing device with a tiltable head.

2. Description of the Related Art

Regarding printing devices in this category, a printing device with a rotatable dot matrix printing head for printing characters in condensed images was disclosed in Japanese Laid-Open Patent Publication No. 62-176852.

As shown in FIG. 6, the printing device according to the Japanese Laid-Open Patent Publication has a dot matrix head 52 rotatably supported at the rotation axle 54. The dot matrix head 52 comprises a plurality of printing pins 50 set along a line. The printing device prints characters having vertically-condensed images by adjusting the tilt angle of the dot matrix head 52 in a plane parallel to the printing surface.

However, printing devices with the above structure have an inherent problem, that is, the printing devices with the above structure require driving units, such as a motor or a solenoid, which bring an increase in the weight of the carriage and in the cost of the device.

In addition to the above problems, the angle of the printing head has to be adjusted, for example, within an accuracy of 0.1 degree, which requires precision parts in the driving unit thus making the construction very difficult and even costlier.

SUMMARY OF THE INVENTION

It is an object of the invention to provide a printing device with a simple structure for enabling the function of fine-tuning the width of the blank space between the printing lines by tilting the printing head in a plane parallel to the printing surface and adjusting the width of the printing lines.

To achieve the above object, the printing device of the invention has a guide axle having a center axis, a carriage with a print head mounted for reciprocal movement along said guide axle, first and second bearing members for supporting the carriage on the guide axle, the first bearing member having an eccentric center, and a rotating member for rotating the first bearing member.

In the printing device of the invention with the above structure, the carriage, with a printing head mounted thereon, moves along the guide axle in a reciprocal motion. The carriage is supported by the first bearing and the second bearing. The first bearing has an eccentric center relative to the second bearing. The printing device also has a rotation member for rotating the bearings.

As described above, with a simple structure of the eccentric first bearing, the printing device of the invention provides the blank space width adjustment operation, for small amounts of adjustment, with ease and accuracy.

BRIEF DESCRIPTION OF THE DRAWINGS

The invention will be described in detail with reference to the drawings, in which.

DETAILED DESCRIPTION OF THE PREFERRED EMBODIMENTS

Figure 1A:
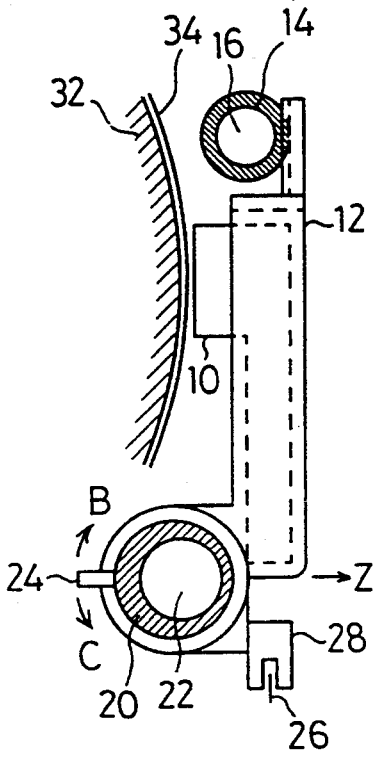
FIG. 1A is a cross sectional side view depicting the main mechanism of the printing device of the invention.
Figure 1B:
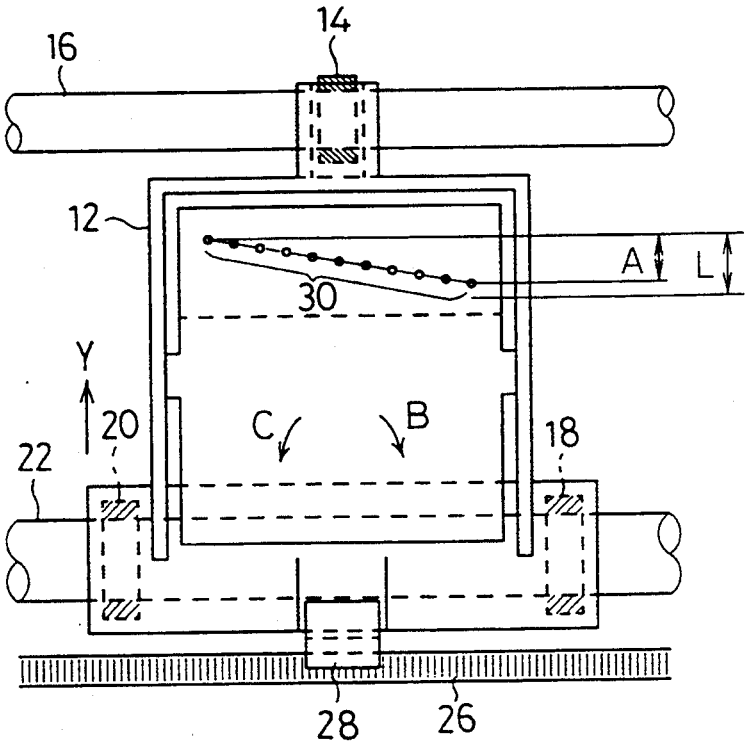
FIG. 1B is a front view depicting the main mechanism of the printing device of the invention.

FIG. 1A shows a side view depicting the main mechanism of the printing device and FIG. 1B provides a front view of the printing device.

A printing head 10 is provided on the carriage 12 for printing characters on a paper 34 by ejecting ink drops. The carriage 12 is provided to move along a pair of guide bars, the upper guide bar 16 and the lower guide bar 22 set parallel to the width of the paper 34. The carriage 12 is supported by the upper guide bar 16 at the upper bearing 14 and by the lower guide bar 22 at a lower-right bearing 18 and a lower-left bearing 20. A carriage motor (not shown in the figure) drives a timing belt and other mechanical trains to control the carriage in reciprocal movement along a print line as is known in the art.

As shown in FIG. 1A, the lower-left bearing 20 has an eccentric axis relative to the lower guide bar 22. A lever 24 is found on the lower-left bearing 20 for rotating the lower-left bearing 20 relative to the axis of the lower guide bar 22. The upper guide bar 16 and the lower guide bar 22 are provided on the frame of the ink jet printer (not shown in the figure). The lower-right bearing has a concentric axis with respect to the lower guide bar 22. The inkjet printer has a linear scale 26 on the frame. The carriage 12 has an encoder 28 for counting the scale marks printed on the linear scale 26. The location of the carriage 12 is decided and controlled according to the reading of the linear scale 26 by the encoder 28.

The printing head 10 has an array of inkjet nozzles 30 consisting of a tiny ports set on an inclined line covering the height of a print line. The printing head ejects ink drops in synchronism with the reciprocal motion of the carriage to form character images on the paper 34 seated on the platen 32.

In the above printing process, as shown in FIG. 1B, the paper feeding step L is given by the following expression where A is the vertical height of the array of inkjet nozzles 30.

$L = A + A/((\text{number of nozzles}) - 1)$

In the printing process, the printing device executes the paper feeding operation by the paper feeding step L to print characters, symbols or pictures extending over a plurality of printing lines on the paper 34. The paper feeding step L often deviates from the designed value because of parts size errors or a lack of precision or inaccuracies introduced in the assembly process.

Figure 2A:
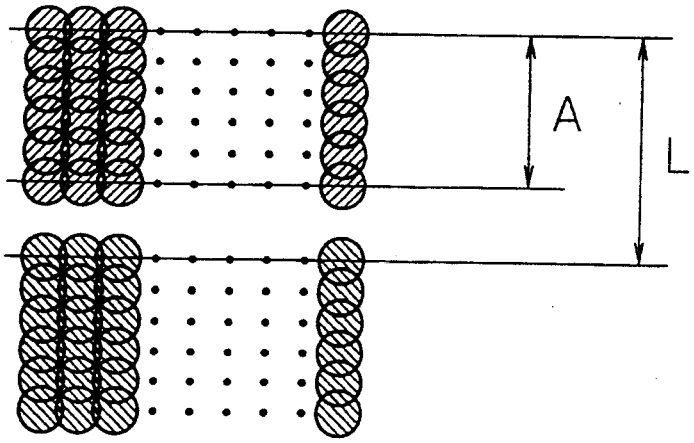
FIG. 2A is a magnified view depicting the printed image with the paper sending step L greater than the prescribed standard value.
Figure 2A:
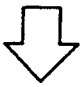

If the paper feeding step L is greater than the designed value, the printed images will have blank spaces interleaving the finally printed lines as shown in FIG. 2A, i.e. an upper portion of the printed line will be separated from the lower portion. Conversely, if the paper feeding step is smaller than the designed value, the printed images overlap at the borders, or edges, of the print portions. In both cases, the deviation of the paper feeding step L from the designed value brings about a substantial degradation in the quality of the printed images. The operator has to adjust the paper feeding step L to minimize the degradation in the quality of the printed images.

As shown in FIG. 2A, if there is a blank space between the print portions, the operator turns the lower-left bearing 20 with the lever 24 (shown in FIG. 1A) in the direction indicated by the arrow B. The operation causes the carriage 12 to tilt clockwise around a virtual pivot near the lower-right bearing 18 relative to the lower guide bar 22. As a result, the print head 10 tilts clockwise, making the vertical projection of the array of print nozzles 30 longer and the width of the print portion wider, thereby eliminating the blank spaces between the print portions.

Figure 3A:
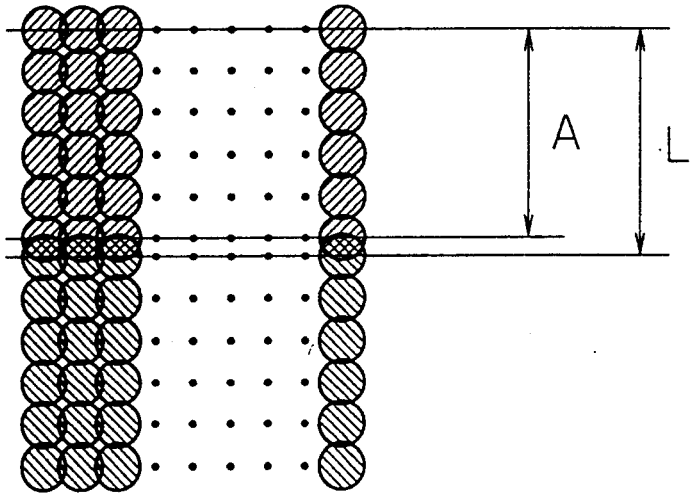
FIG. 3A is a magnified view depicting the printed image with the paper sending step L smaller than the prescribed standard value.
Figure 3B:
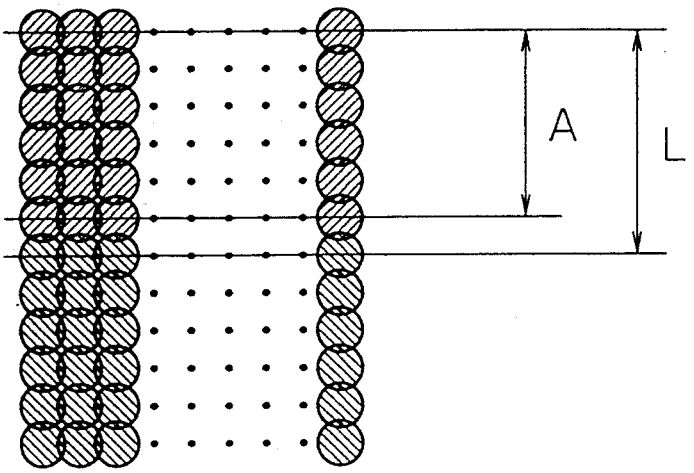
FIG. 3B is a magnified view depicting the printed image with the paper sending step L smaller than the prescribed standard value after an adjustment is made to compensate for the offset in the paper sending step.

On the other hand if, as shown in FIG. 3A, the print portions overlap on the borders, the operator turns the lower-left bearing 20 with the lever 24 (shown in FIG. 1A) in the direction indicated by arrow C by the necessary angle required to obtain print like that shown in FIG. 3B. The operation causes the carriage to tilt counterclockwise around a pivot near the lower-right bearing 18 relative to the lower guide bar 22. As a result, the print head 10 tilts counterclockwise, making the vertical projection of the array of print nozzles 30 shorter and the width of the print portion narrower, eliminating the overlapped print area.

Figure 4:
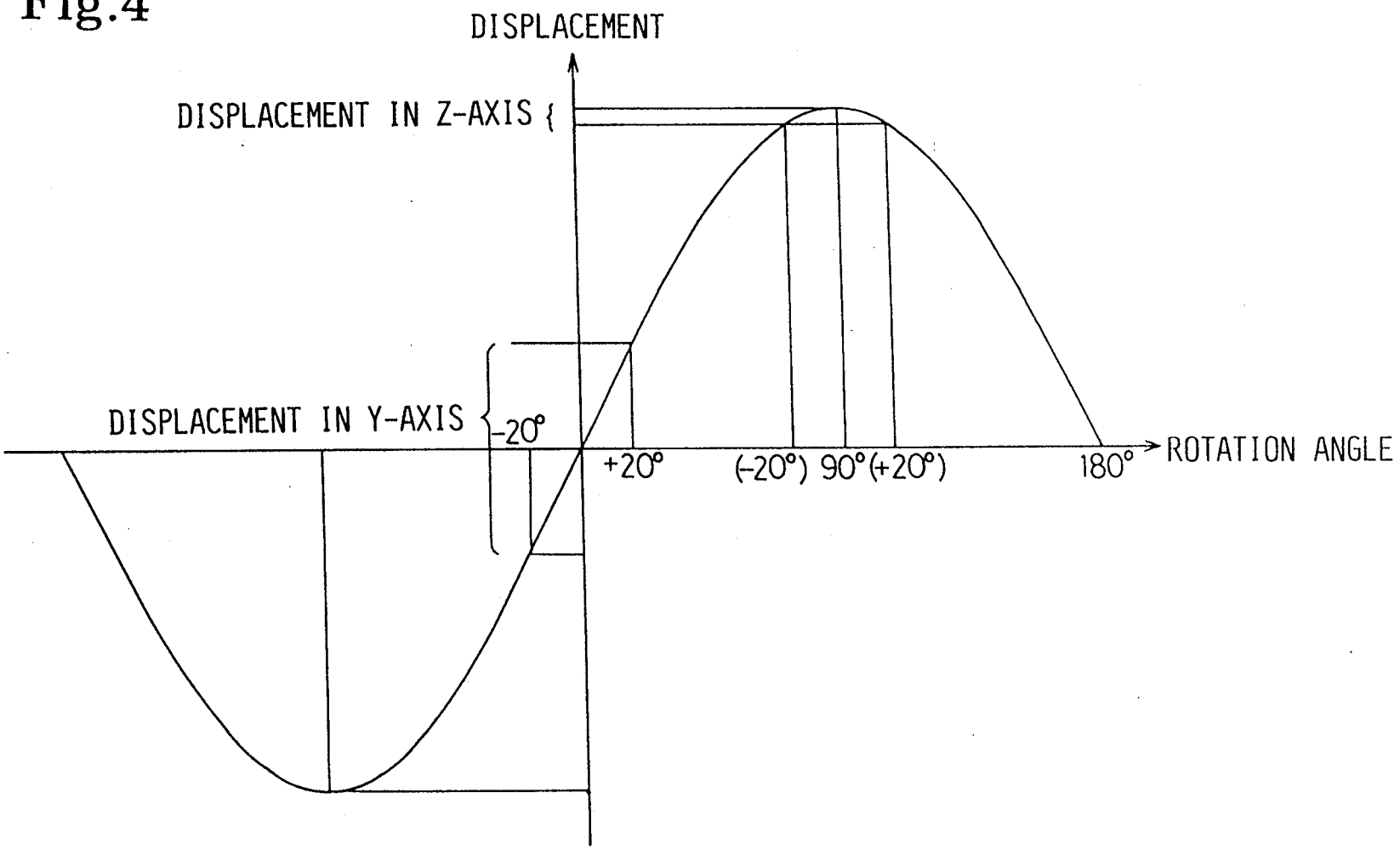
FIG. 4 is a chart illustrating the dependence of the displacement of the eccentric bearing 20 on the rotation angle.

As shown in FIG. 1A, turning the lower-left bearing 20 in one direction causes the joint of the lower-left bearing 20 to shift in the Y-axis and Z-axis. Since the printing device of the preferred embodiment has an eccentric bearing in the lower-left bearing 20, the displacement-tilt angle curve is given in FIG. 4. FIG. 4 shows the dependence of the displacement of the joint of the lower-left bearing 20 on the tilt angle of up to 20 degrees in both directions. The displacements in the Y-axis and Z-axis have a phase differential of 90 degrees from each other. As shown in FIG. 4, the displacement in the Z-axis is very small compared with the displacement in the Y-axis. Thus, the displacement in the Z-axis has a negligible influence on the vertical projection of the array of print nozzles 30. Consequently, the above construction allows the printing device to adjust the height of the print lines without calibrating the clearance between the print head 10 and the paper 34.

Figure 2B:
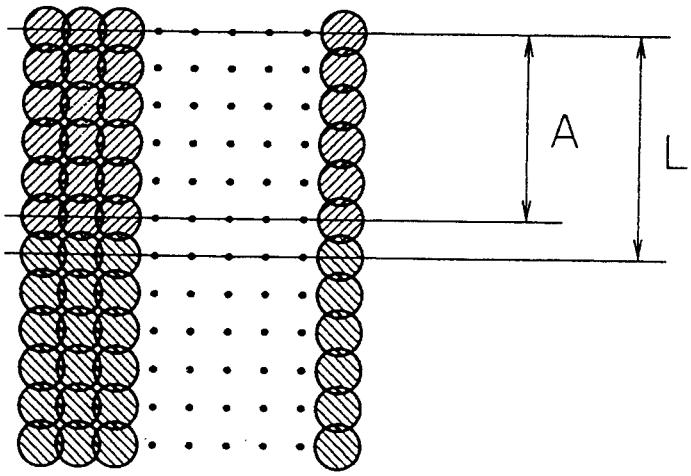
FIG. 2B is a magnified view depicting the printed image with the paper sending step L greater than the prescribed standard value after an adjustment is made to compensate for the offset in the paper sending step.
Figure 5:
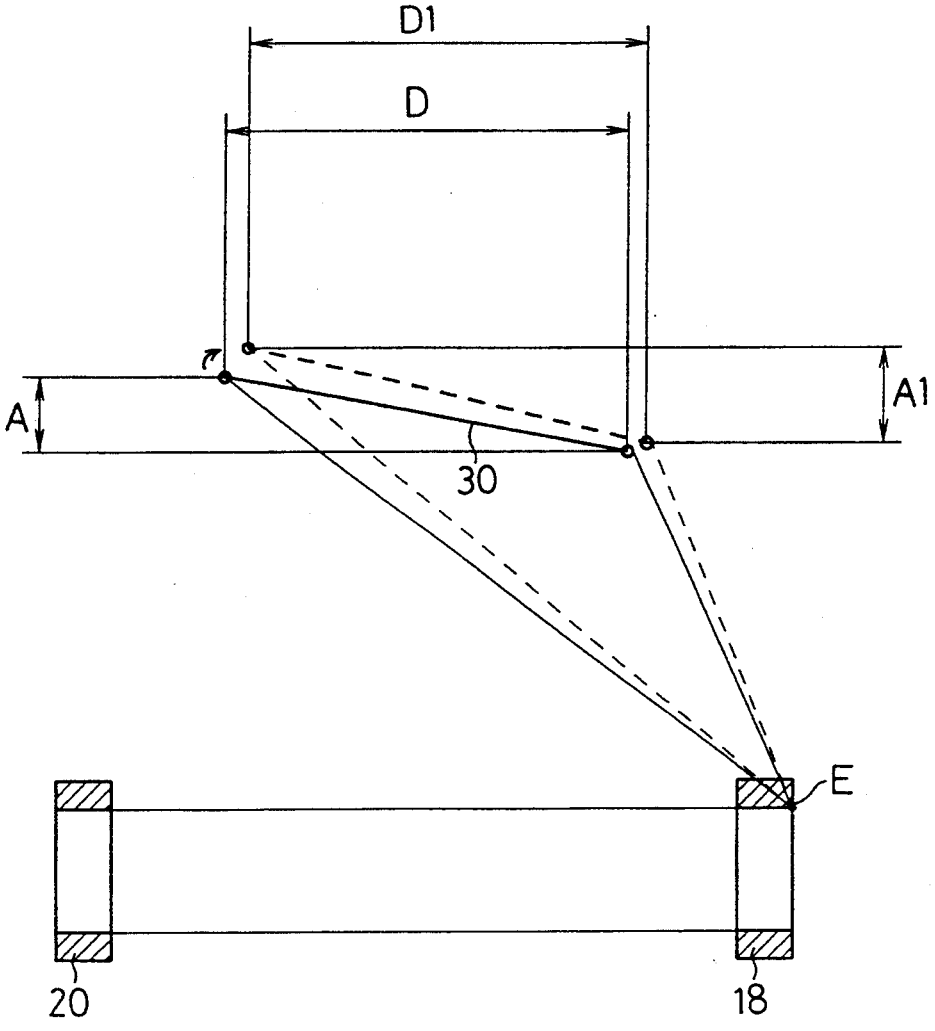
FIG. 5 is a chart depicting the transitional motion of the printing head displaced from the FIG. 2A state to that of the FIG. 2B state.
Figure 6:
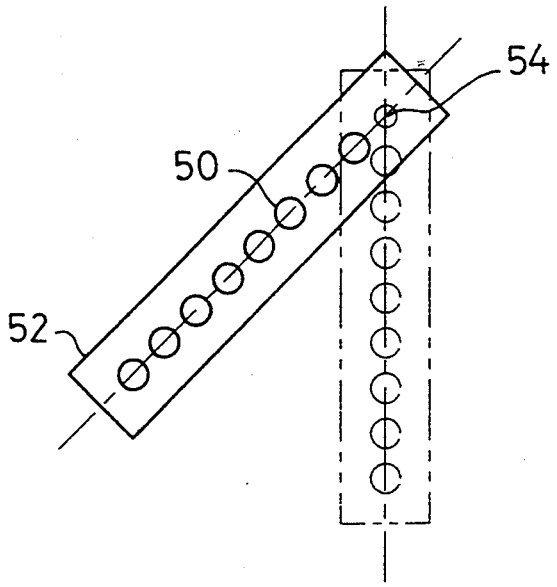
Fig.6 RELATED ART
FIG. 6 is a chart depicting the printing head with a conventional adjusting mechanism.

FIG. 5 shows the print area when the FIG. 2A-state exists and when the FIG. 2B state exists. In FIG. 5, it is shown that the print area 30 rotates clockwise around a virtual pivot near the point E of the lower-right bearing 18. The variance rate in the horizontal width of the print area is D1/D, significantly smaller than variance rate A1/A in the vertical height, resulting in minimal dislocation of the print area without degradation in the quality of the printed images.

For example, the tilt angle of the print head 10 is 0.06 degree for the tilt angle of 20 degrees at the lower-left bearing 20, when the eccentric center of the lower-left bearing 20 is deviated from center round by 0.3 mm, and the horizontal distance between the lower-right bearing 18 and the lower-left bearing 20 is 100 mm. The tilt angle of 20 degrees at the lower-left bearing 20 is adjusted manually by the operator, thus facilitating control of the print area height control.

The described embodiment does not limit the scope of the invention. Various modifications can be made to the embodiment within the scope of the invention. For example, the lower-right bearing 18 may be eccentric instead of the lower-left bearing 20.

Further, both the lower-right bearing 18 and the lower-left bearing 20 may be eccentric. In this modification, both bearings are assembled with common parts, enabling more accurate print area width control. This modification is realized by fitting the lower-right bearing on the carriage 12 so that the lower-right bearing 18 does not rotate relative to the lower guide bar 22.

Figure 1C:
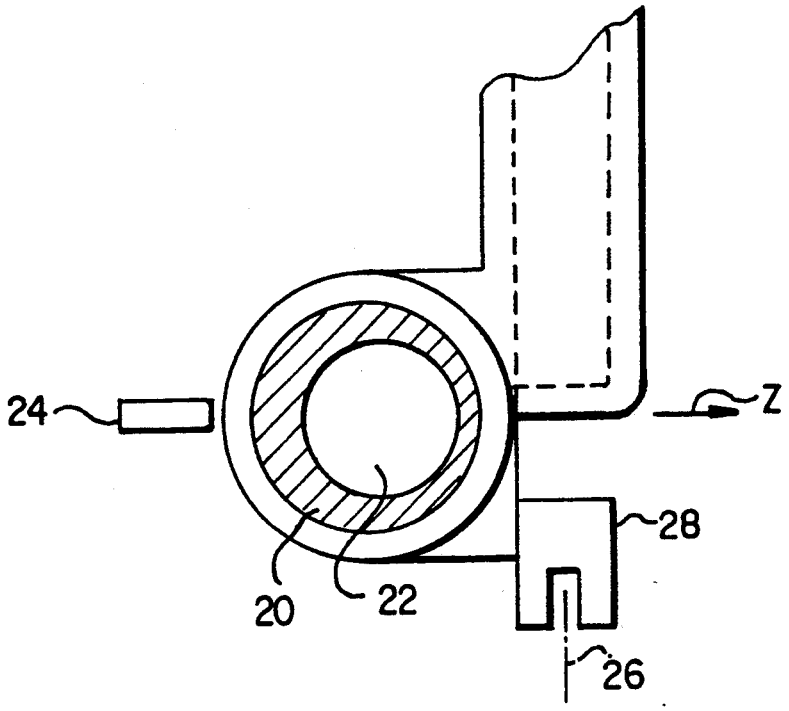
FIG. 1C is an enlarged view of a portion of FIG. 1A.

Furthermore, the lever 24 can be detachably attached to the rotatable bearing as shown in FIG. 1C.

What is claimed is:

1. A printing device having a platen, comprising:

a guide axle having a center axis;

a carriage with a printing head provided for reciprocal movement along said guide axle;

a first bearing member and a second bearing member for supporting the carriage on said guide axle, said first bearing member having an eccentric center; and a rotating member for rotating only said first bearing member.

2. The printing device as claimed in claim 1, further comprising a second guide axle providing an upper guide axle, wherein said first bearing member and said second bearing member support the carriage on said guide axle which constitutes a lower guide axle.

3. The printing device as claimed in claim 2, further comprising a third bearing for supporting the carriage on said upper guide axle.

4. The printing device as claimed in claim 3, wherein said first bearing member and said second bearing member are mounted at a lower portion of the print carriage, said first bearing member and said second bearing member being separated from one another, and said third bearing member being mounted at a mid-point of an upper portion of the carriage.

5. The printing device as claimed in claim 1, wherein the printing head has a plurality of print elements, the print elements of said printing head lying along a line that is angled relative to a line parallel to an axis of the platen.

6. The printing device as claimed in claim 2, wherein the printing head has a plurality of print elements positioned along a line that is sloped with respect to the upper and lower guide axles.

7. The printing device as claimed in claim 1, wherein said rotating member rotates said first bearing member at the eccentric center.

8. The printing device as claimed in claim 2, wherein said second bearing member has a concentric center.

9. The printing device as claimed in claim 3, wherein said third bearing member has a concentric center.

10. An adjustable printing device for a printer having a platen, an upper guide bar and a lower guide bar running parallel to one another, comprising:

a print carriage mounted to the upper and lower guide bars for reciprocal movement, said print carriage having a lower section with a first bearing at one end of said lower section and a second bearing at an opposite end of said lower section, said first bearing and said second bearing being separated from one another and having the lower guide bar passing therethrough, a third bearing mounted at a mid-point of an upper edge of said print carriage having the upper guide bar passing therethrough;

a print head having a plurality of print elements mounted to said print carriage in opposing relationship to the platen, wherein said first bearing has an eccentric axis, wherein said first bearing is rotatable about the lower guide bar.

11. The adjustable printing device as claimed in claim 10, further comprising a rotating member for rotating said first bearing about the lower guide bar.

12. The adjustable printing device as claimed in claim 11, wherein print elements of said print head lie along a line that is angled relative to a line parallel to an axis of the platen.

13. The adjustable printing device as claimed in claim 11, wherein said second bearing has a concentric axis.

14. The adjustable printing device as claimed in claim 11, wherein said rotating member is removable.

15. An adjustable printing apparatus for use with a printer employing a print carriage mounted for reciprocal movement along an upper guide bar and a lower guide bar, the apparatus comprising:

a first bearing mounted at a mid-point of a one of a upper portion and a lower portion of the print carriage;

a second bearing and a third bearing mounted at an opposite one of the upper portion and the lower portion of the print carriage, said second bearing and said third bearing adjacent opposite side edges of said print carriage so as to have a gap between themselves;

a print head having a plurality of print elements positioned along a line that is sloped with respect to the upper and lower guide bars, wherein a one of said second bearing and third bearing has a eccentric axis, wherein said bearing having the eccentric axis is rotatable about the lower guide bar.

16. The adjustable printing apparatus as claimed in claim 15, further comprising a rotating member for rotating said bearing having the eccentric axis about the lower guide bar.

17. The adjustable printing apparatus as claimed in claim 15, wherein a one of said second bearing and said third bearing has a concentric axis.

18. The adjustable printing apparatus as claimed in claim 16, wherein the print elements of said print head lie along a line that is angled relative to a line parallel to an axis of a platen provided opposite to said print head.

* * * * *